US006685583B2

(12) United States Patent
Severa et al.

(10) Patent No.: US 6,685,583 B2
(45) Date of Patent: Feb. 3, 2004

(54) HANDLE FOR A SPORTS RACQUET

(75) Inventors: William D. Severa, West Chicago, IL (US); Po-Jen Cheng, Oak Brook, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/995,184

(22) Filed: Nov. 27, 2001

(65) Prior Publication Data

US 2003/0100389 A1 May 29, 2003

(51) Int. Cl.[7] ..... A63B 49/08
(52) U.S. Cl. ..... 473/549; 473/551; 473/523
(58) Field of Search ..... 473/549, 551, 473/568, 300, 521, 523

(56) References Cited

U.S. PATENT DOCUMENTS

| | | | | | |
|---|---|---|---|---|---|
| 1,611,925 | A | * | 12/1926 | Link | 473/298 |
| 2,659,605 | A | * | 11/1953 | LeTourneau | 473/568 |
| 3,674,267 | A | | 7/1972 | Hollis | 273/75 |
| 4,098,506 | A | * | 7/1978 | Gaiser | 473/538 |
| 4,402,508 | A | * | 9/1983 | Pflueger | 473/551 |
| 4,660,832 | A | | 4/1987 | Shomo | 273/73 |
| 4,717,151 | A | * | 1/1988 | DuBois | 473/551 |
| 4,989,870 | A | | 2/1991 | Janes | |
| 5,034,082 | A | * | 7/1991 | Nolan | 156/245 |
| 5,118,107 | A | * | 6/1992 | Bucher | 473/299 |
| 5,135,223 | A | | 8/1992 | You | 273/73 |
| 5,155,878 | A | * | 10/1992 | Dellis | 16/421 |
| 5,178,387 | A | * | 1/1993 | Kuebler | 473/523 |
| 5,286,022 | A | | 2/1994 | You | 273/73 |
| 5,491,015 | A | * | 2/1996 | Reeves et al. | 428/167 |
| 5,599,019 | A | | 2/1997 | Davis et al. | |
| 5,624,116 | A | | 4/1997 | Yeh | |
| 5,671,926 | A | | 9/1997 | Hagey | |
| 5,711,720 | A | | 1/1998 | Janes et al. | |
| 5,730,662 | A | * | 3/1998 | Rens | 473/300 |
| 5,897,448 | A | | 4/1999 | Chang | |
| 5,924,941 | A | * | 7/1999 | Hagey | 473/551 |

FOREIGN PATENT DOCUMENTS

| | | | | |
|---|---|---|---|---|
| CN | 87114893 | | 4/1999 | |
| DE | 3831586 | * | 3/1990 | B25G/1/10 |
| EP | 0 388 764 A | | 9/1990 | |
| JP | 5-84336 | * | 4/1993 | A63B/53/14 |

* cited by examiner

*Primary Examiner*—Raleigh W. Chiu
(74) *Attorney, Agent, or Firm*—Terence P. O'Brien

(57) ABSTRACT

A handle assembly for a sports racquet having a head portion. The handle assembly includes an elongate handle, a pallet, a pad and a cover layer. The elongate handle is coupled to the head portion. The pallet is coupled to and longitudinally extends along the handle. The pallet has a proximal portion, a distal portion and a gripping portion disposed between the proximal and distal portions. The gripping portion is stepped down with respect to the proximal and distal portions to form a peripheral recess. The pad has an inner surface and an outer surface. The inner surface of the pad is coupled to the gripping portion of the pallet. The cover layer extends over and substantially covers the pad, and generally covers the proximal and distal portions of the pallet. The cover layer can include indicia including graphical indicia, alphanumeric indicia, or combinations thereof.

31 Claims, 6 Drawing Sheets

HANDLE FOR A SPORTS RACQUET

FIELD OF THE INVENTION

The present invention relates generally to a sports racquet. In particular, the present invention relates to a handle assembly for a sports racquet wherein the handle assembly includes a padded grip portion, a cover layer and a grip.

BACKGROUND OF THE INVENTION

Sport racquets, such as tennis, racquetball, squash and badminton racquets, are well known and typically include a head portion coupled to a handle assembly. The head portion forms a hoop supporting a latticework of tensioned strings. The handle assembly typically includes a handle, a pallet and a grip. The pallet is typically either attached to, or integrally formed to, the handle, and the pallet is commonly formed of a hard material, such as graphite, structural polyurethane foam or wood. The grip is typically helically wrapped through the use of an adhesive to the pallet.

It is not uncommon for a substantial amount of shock and vibration to be generated from the racquet upon striking a ball, particularly where the point of the impact occurs away from a central region of the racquet head, commonly referred to as the "sweet spot." Such impacts typically create a shock wave that travels from the racquet head, up the handle, to the grip, and to the hand, arm and shoulder of the user. This shock and vibration can be harsh, uncomfortable, and even harmful, to certain users. At a minimum, the shock and vibration can negatively affect the user's feel of the racquet and can provide the user with a negative impression of the racquet. Although the grip provides some cushioning or dampening effect, the grip alone does not substantially reduce the shock and vibration felt by the user.

Additionally, racquet grips are wear items that typically require replacement after repeated use. The useful life of a grip depends largely upon the amount and severity of use. For example, it is not uncommon for many tennis players, who play on a regular basis, to replace their grips due to grip wear. Grip replacement is a labor-intensive activity due, in large part, to the need to scrape or otherwise remove the worn grip material and layers of grip adhesive from the roughened outer surface of the pallet. Moreover, the roughened outer surface of the pallet can inhibit the proper application of a replacement grip. Further, racquets with worn grips typically do not include instructions on how to properly replace the grip or recommendations on the type, model or size of replacement grip to use. The absence of such information can contribute to improper selection of a replacement grip or to incorrect application of the replacement grip, particularly when the person performing the selection and/or application has little or no experience.

Thus, there is a continuing need for a racquet with an improved handle assembly that can further reduce the shock and vibration felt by a user during play. What is also needed is an improved handle assembly that improves the feel of the racquet. Further, it would be advantageous to provide a handle assembly configured to facilitate subsequent grip replacements. It is also desirable to provide a handle assembly that can be adapted to include information relating to grip replacement and other topics of interest to a user.

SUMMARY OF THE INVENTION

The present invention provides a handle assembly for a sports racquet having a head portion. The handle assembly includes an elongate handle, a pallet, a pad and a cover layer. The elongate handle is coupled to the head portion. The pallet is coupled to and longitudinally extends along the handle. The pallet has a proximal portion, a distal portion and a gripping portion disposed between the proximal and distal portions. The gripping portion is stepped down with respect to the proximal and distal portions to form a peripheral recess. The pad has an inner surface and an outer surface. The inner surface of the pad is coupled to the gripping portion of the pallet. The cover layer extends over and substantially covers the pad, and generally covers the proximal and distal portions of the pallet.

According to a principal aspect of a preferred form of the invention, a handle assembly for a sports racquet has a head portion and includes an elongate handle, a plalet, a cover layer and a grip. The handle is coupled to the head portion. The pallet is coupled to and longitudinally extending along the handle. The cover layer extends over and generally covers the pallet. The cover layer includes indicia including graphical indicia, alphanumeric indicia, or combinations thereof. The grip is wrapped around the cover layer.

According to another preferred aspect of the invention a handle assembly for a sports racquet has a head portion. The handle assembly includes an elongate handle, a pad and a cover layer. The elongate handle is coupled to the head portion and extends along a longitudinal axis. The handle defines a pallet having a proximal portion, a distal portion and a gripping portion disposed between the proximal and distal portions. The distal portion has a first transverse cross-sectional area and the gripping portion having a second transverse cross-sectional area. The second polygonal cross-sectional area is smaller than the first polygonal cross-sectional area to define a peripheral recess in the pallet. The pad is removably coupled to the gripping portion of the pallet. The pad substantially fills the recess and has a thickness at least as great as the depth of the recess. The cover layer extends over and substantially covers an outer surface of the pad. The cover layer also generally covers the proximal and distal portions of the pallet.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
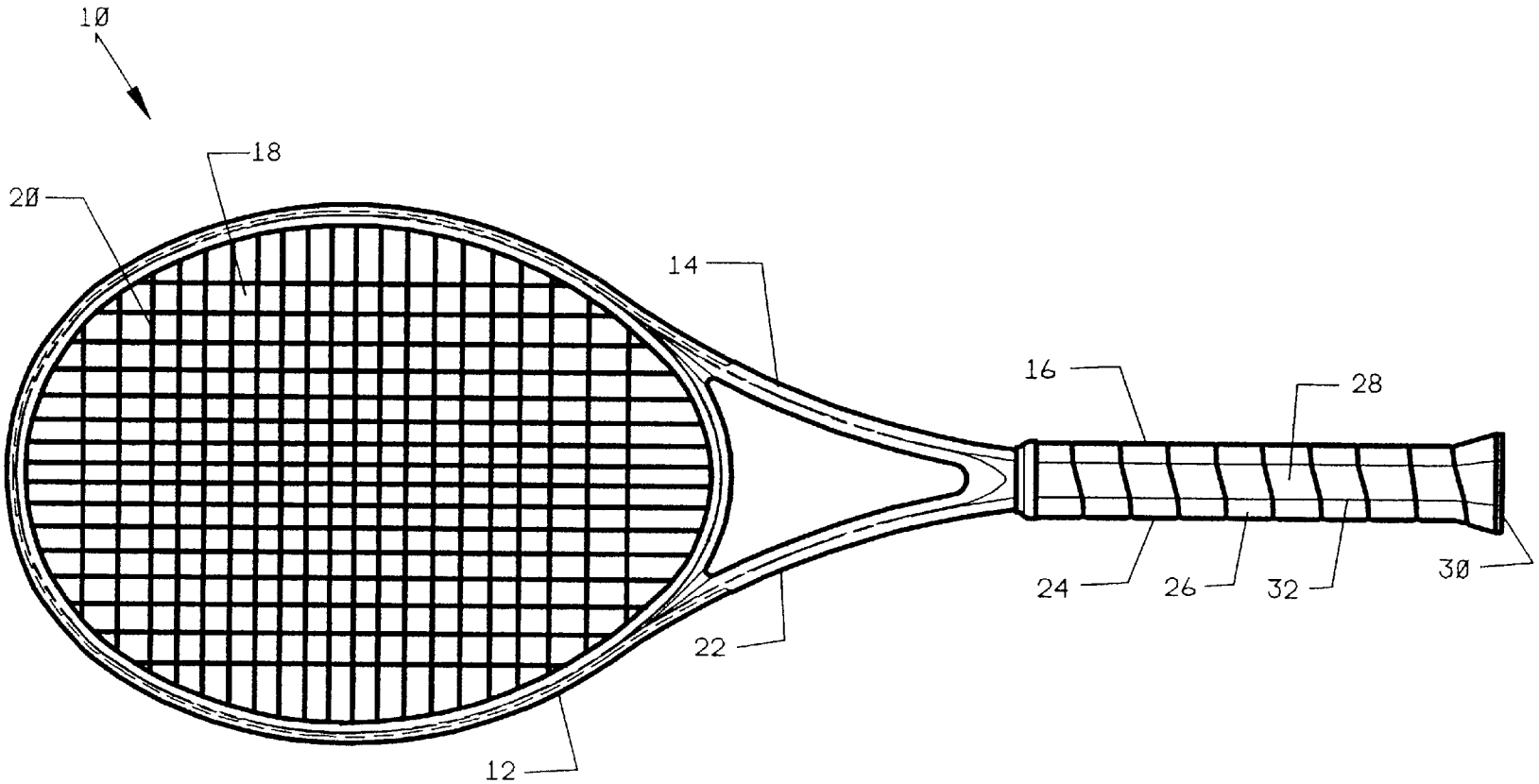
FIG. 1 is front perspective view of a racquet in accordance with a preferred embodiment of the present invention.

Referring to FIG. 1, a sports racquet is indicated generally at 10. The racquet 10 of FIG. 1 is configured as a tennis racquet, however, the invention can also be formed as other types of sports racquets, such as, for example, a racquetball racquet, a squash racquet, or a badminton racquet. The racquet 10 includes a frame defining a head portion 12, a throat region 14 and a handle assembly 16. The head portion 12 is a tubular structure defining a generally oval shaped opening 18. The head portion 12 maintains in tension a latticework of strings 20. The throat region 14 includes a pair of tubular shafts 22 outwardly extending from the head portion 12 and converging at the handle assembly 16. The throat region 14 couples the head portion 12 to the handle assembly 16. In one preferred embodiment, the pair of tubular shafts 22 is integrally formed with the head portion 12 and the handle assembly 16. In an alternative preferred embodiment, the throat region 14 can include an elastomeric isolator (not shown) positioned between the pair of tubular shafts 22 and the head portion 12. The handle assembly 16 connects to and outwardly extends from the throat region 14 along a longitudinal axis 15.

Figure 2:
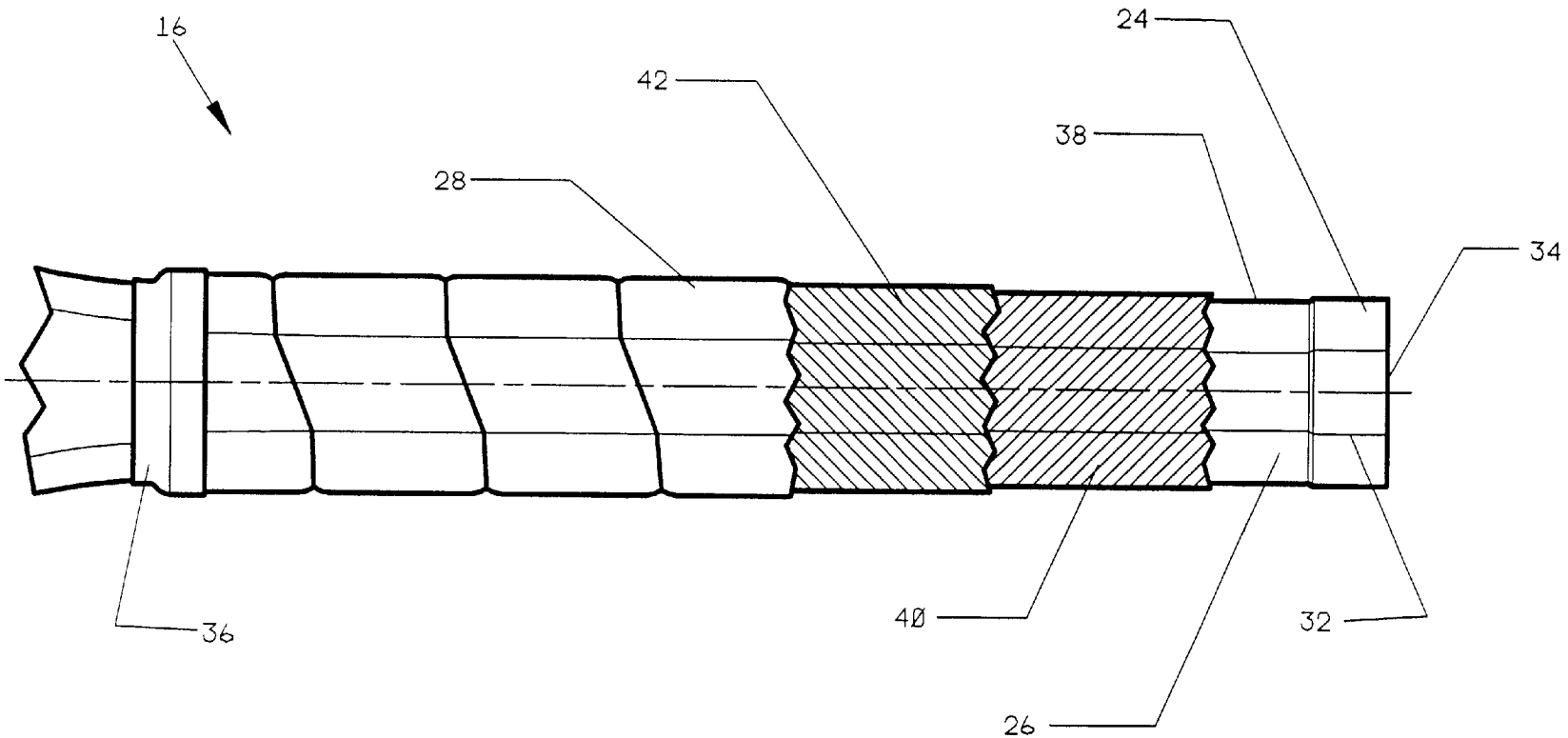
FIG. 2 is a front sectional view of a handle assembly of the racquet of FIG. 1.
Figure 3:
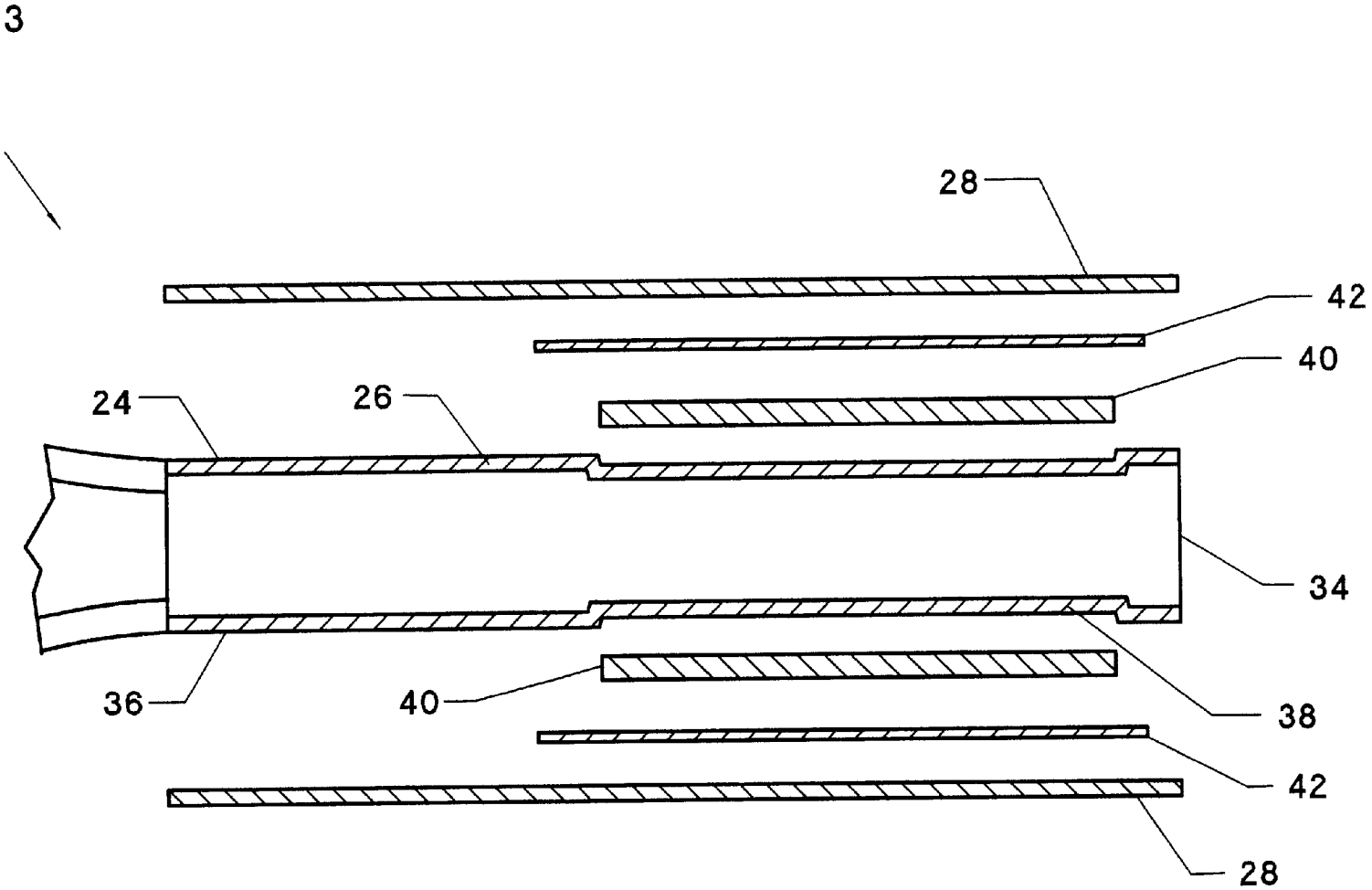
FIG. 3 is an exploded longitudinal cross-sectional view of the handle assembly of FIG. 1.

Referring to FIGS. 2 and 3, the handle assembly 16 is shown in greater detail. The handle assembly 16 includes a handle 24, a pallet 26, a grip 28, and a butt cap 30 (see FIG. 1). The handle 24 is a rigid structure preferably forming the pallet 26. The pallet 26 is preferably integrally molded into the handle 24 to define a rigid gripping member. The pallet 26 has butt portion 34 (or proximal portion) and a hoop portion 36 (or distal portion). The pallet 26 preferably has an octagonal transverse cross-section formed by eight outer longitudinally extending surfaces interconnected along eight longitudinally extending gripping edges 32. In alternative preferred embodiments, the pallet 26 can have alternative transverse cross-sectional shapes such as, for example, other polygonal shapes, oval, circular and irregular. The pallet 26 is configured for grasping by one or both hands of a player during use. The pallet 26 is made of a strong, lightweight, durable material, preferably a graphite composite material. Alternatively, the pallet 26 can be formed of other materials, such as, for example, other fiber composite materials, a structural urethane foam, other structural foams, a plastic material, a metal or wood. In a preferred embodiment, the pallet 26 has a length between 5.0 and 9.5 inches; and, in a particularly preferred embodiment, the pallet 26 has a length of approximately 7.0 to 8.0 inches. In an alternative preferred embodiment, the pallet is a separate component connected to a "hair-pin" shaped handle.

A peripheral recess 38 is defined within the pallet 26 between the butt and hoop portions 34 and 36 of the pallet 26. The recess 38 uniformly and inwardly extends into the eight outer surfaces 31 of the pallet 26, such that the transverse cross-sectional area of the pallet 26 at any point along the recess 38 is smaller than the transverse cross-sectional area at either the butt portion 34 or the hoop portion 36 of the pallet 26. The recess 38 is positioned toward the butt portion 34 of the pallet, preferably within approximately 1.0 centimeter from the butt portion 34 of the handle assembly 16. The recess 38 has a length between 3.5–7.0 inches and a depth between 0.25–3.0 millimeters. In a particularly preferred embodiment, the recess 38 has a length of approximately 4.0 inches and a depth of approximately 0.7 millimeters. In an alternative preferred embodiment, the recess 38 can fully extend to, and encompass, the butt portion 34.

The handle assembly 16 further includes a pad 40 and a cover layer 42. The pad 40 is a flexible sheet of padding attached to the pallet 26 at the recess 38. The pad 40 wraps around and substantially fills the recess 38. In a preferred embodiment, the pad 40 is affixed to the pallet 26 using a suitable adhesive tape. Alternatively, the pad 40 can be attached to the pallet by other means, such as, for example, a fluid adhesive. The pad 40 is preferably made of a soft, flexible, resilient foam material. In a particularly preferred embodiment, the pad 40 is a micro-cellular, polyurethane open-celled foam having a smooth outer surface. In alternative preferred embodiments, the pad 40 can be made of other materials, such as, for example, other open or closed cell foams, or other cushionable materials. The pad 40 has a thickness that is at least as great as the depth of the recess 38. In a particularly preferred embodiment, the pad 40 has a total thickness of approximately 1.0 millimeter and the pad 40 outwardly extends from the pallet 26 by approximately 0.3 millimeters. The pad 40 is optimally sized and positioned along the pallet 26 to match the player's typical hand grip location. The pad 40 further reduces the shock and vibration felt by the player when striking a ball. The pad 40 also improves the overall "feel" of the racquet.

The cover layer 42 is a thin sheet wrapped about the pallet 26 and substantially covering the pad 40. In a preferred embodiment, the cover layer 26 is sized to cover the entire pad 40 and a portion of the pallet 26 at either end of the pad 40. In another preferred embodiment, the cover layer 42 is preferably sized to substantially cover the entire pad 40 and the entire pallet 26. The cover layer 42 is made of a thin, flexible and shrinkable material such as a polystyrene or polyvinylchloride. Alternatively, other materials can be used such as, for example, a polyolefin material or other shrinkable or conformable materials. In a preferred embodiment, the cover layer 42 is a shrink wrapped material that is thermally applied over the outer surface of the pad 40 and at least a portion of the pallet 26 at either end of the pad 40. In a particularly preferred embodiment, an adhesive is also applied to the inner surface of the cover layer 42 to affix the cover layer 42 in place. The adhesive advantageously prevents slipping or twisting of the cover layer 42 during use. The cover layer 42 is also preferably formed of a material that is translucent, transparent, semi-translucent or semi-transparent. The cover layer 42 can also be non-transparent, non-translucent, single-colored, multi-colored, tinted or non-tinted. When installed on the handle assembly 16, the cover layer 42 preferably bears against the outer surface of the pad 40 and slightly compresses the pad 40 such that the region of the handle assembly 14 covered by the cover layer 42 has a generally constant transverse cross-sectional area.

The outer surface of the cover layer 42 is smooth and configured for attachment with the grip 28. In a preferred embodiment, the grip 28 is affixed to the outer surface of the cover layer 42 and any uncovered portion of the pallet 26 using a suitable adhesive tape. Alternatively, the grip 28 can be attached to cover layer 42 and any uncovered portion of the pallet 26 by other means, such as, for example, a conventional fluid adhesive, thermal bonding or mechanical bonding. The grip 28 is an elongate strip of soft, durable material. The grip 28 can be made of a leather, a synthetic leather, a rubber or other thermoset material. The grip 28 is typically spirally or helically wrapped about the outer surface of the cover layer 42 and any uncovered portions of the pallet 26. In an alternative preferred embodiment, the grip 28 can be a tubular member that is slidably connected to the outer surface of the cover layer 42 and any uncovered portions of the pallet 26. The smooth outer surface of the cover layer 42 facilitates subsequent re-gripping activities. The smooth outer surface of the cover layer 42 enables an existing grip and existing adhesive to be readily, easily and quickly removed from the handle assembly 14 during re-gripping. As a result, the cover layer 42 enables the racquet 10 to be re-gripped more quickly and easily than a racquet without a cover layer.

Figure 4:
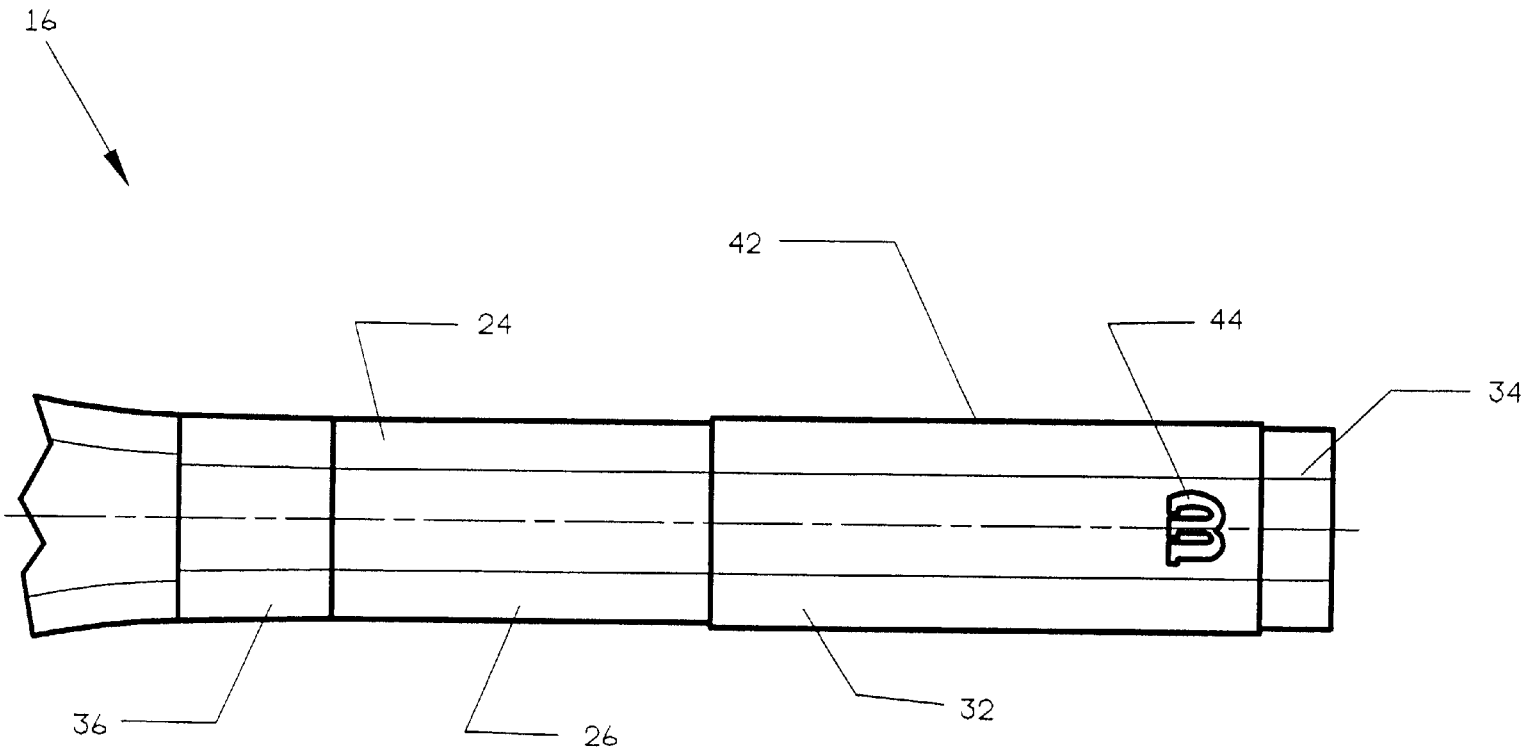
FIG. 4 is a front view of the handle assembly of FIG. 1 shown without a grip.

Referring to FIG. 4, the handle assembly 16 is shown without the grip 28. The cover layer 42 preferably includes indicia 44 representative of alphanumeric characters, graphics, specification information, advertising information, source data, trademarks, certification marks and combinations thereof. Specification information may include information such as installation instructions, dimensions, warnings, bar codes, test results and design features. Advertising information may include information such as slogans, product ratings, product attributes and information on related products. The indicia 44 may be single or multi-colored. In a particularly preferred embodiment, the indicia include grip replacement recommendations and/or instructions. By placing grip replacement instructions and/or recommendations on the cover layer 42 underneath the grip 28, the instructions and/or recommendations are not worn away, lost or misplaced. Further, the replacement instructions and/or recommendations are only visible when needed, when the grip 28 is removed for re-gripping. The availability of this type of information can facilitate re-gripping activities, particularly for those persons with little or no re-gripping experience.

The thin, slightly compressed pad 40 and the thin cover layer 42 enable the player to receive the benefits of a softer more comfortable handle assembly 16 without losing the feel of the gripping edges 32 of the pallet 26. Thus, the player can still use the gripping edges 32 for measuring and gauging his or her grips during play while enjoying the improved feel, and the reduced shock and vibration, provided by the pad 40.

Figure 5:
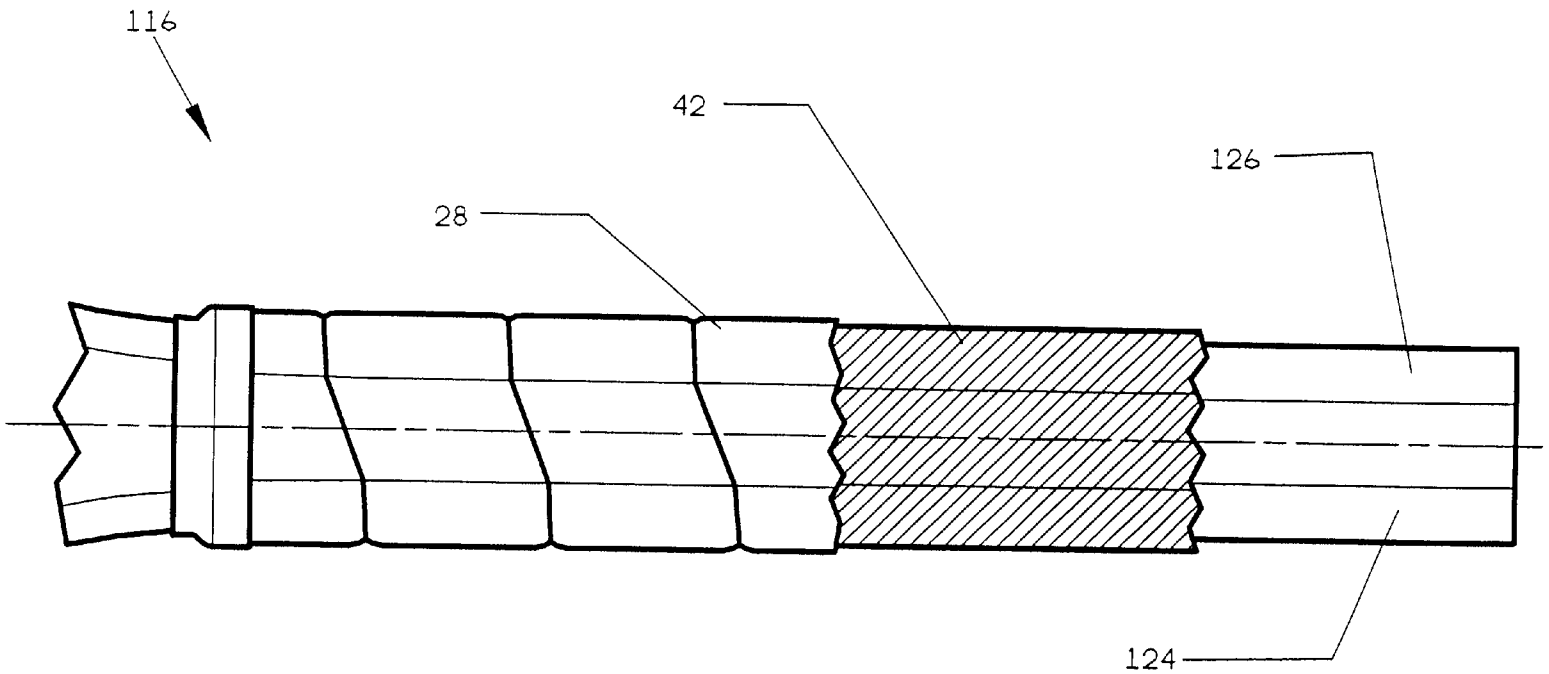
FIG. 5 is a front sectional view of a handle assembly of a racquet according to an alternative preferred embodiment of the present invention.

Referring to FIG. 5, an alternative preferred embodiment of the present invention is illustrated. In the alternative preferred embodiment, a handle assembly 116 is configured to be substantially similar to the handle assembly 16, with exception of the handle assembly 116 being formed without a peripheral recess and without a pad. The handle assembly 116 includes the cover layer 42 and the grip 28. The cover layer 42 is positioned over a pallet 126 of the handle assembly 116 and the grip 28 is connected to the outer surface of the cover layer 42. The cover layer 42 includes the smooth outer surface, which facilitates the removal of the grip 28 and adhesive tape during re-gripping activities, and provides a location for the indicia 44 such as, for example, grip replacement recommendations and/or instructions.

Figure 6:
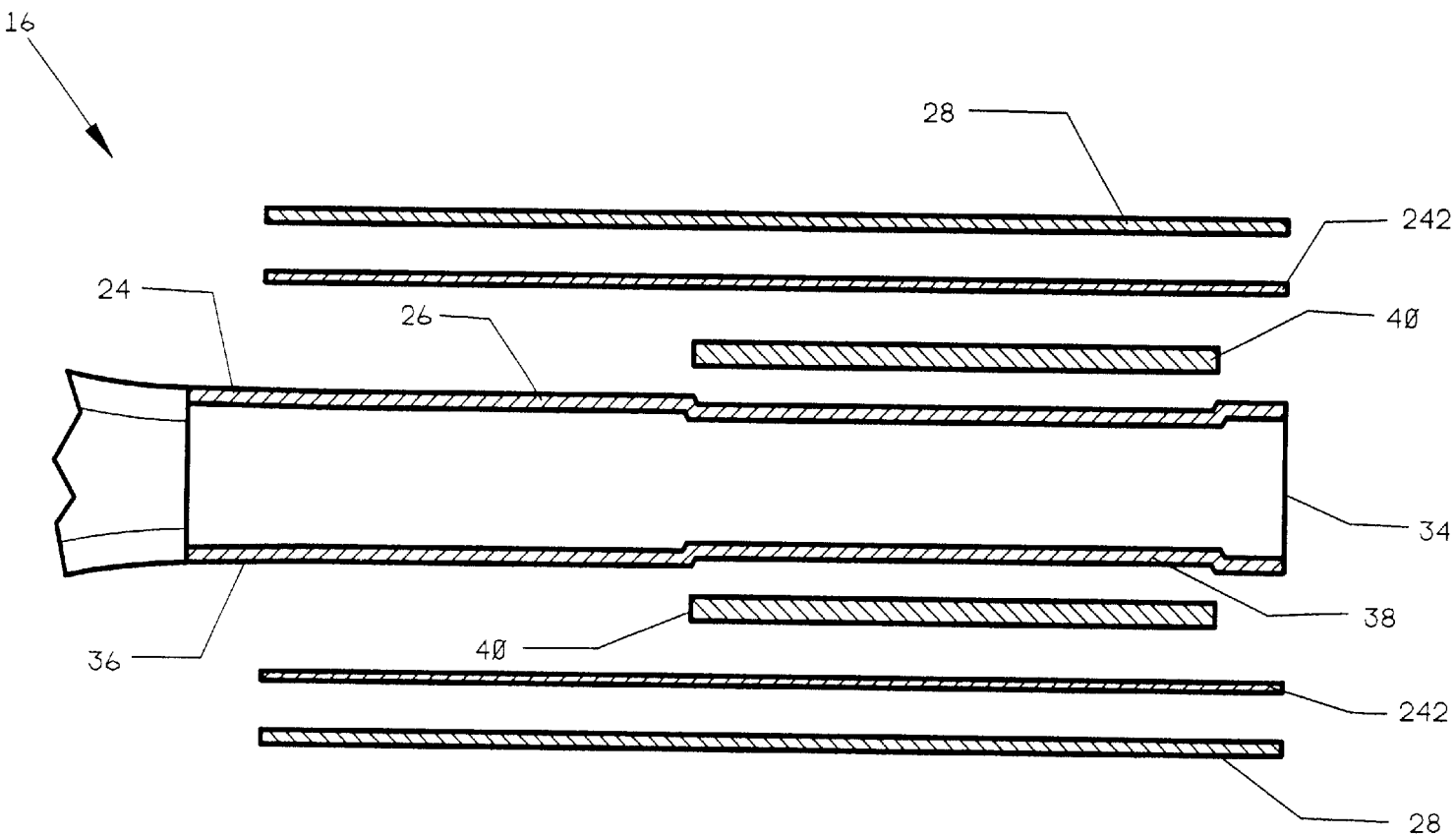
FIG. 6 is an exploded longitudinal cross-sectional view of a handle assembly in accordance with another alternative preferred embodiment of the present invention.

Referring to FIG. 6, another alternative preferred embodiment of the present invention is illustrated. In this alternative preferred embodiment, a handle assembly 16 includes the pallet 26, the pad 40 and an elastomeric coating 242. The elastomeric coating 242 is a durable, resilient, generally tactile film. The coating 242 preferably substantially covers the pallet 26 and the pad 40. Alternatively, the coating 242 can cover the pad 40 and a portion of the pallet 26 at each end of the pad 40. The coating 242 is applied to the outer surface of the pallet 26 and the pad 40, preferably by dipping the handle assembly 16 into the coating 242 in liquid form. The coating 242 while in a liquid state can also include solvents which evaporate, or otherwise substantially separate from the coating 242, as the coating 242 cures. The coating 242 can be semi-translucent, semi-transparent, non-transparent, non-translucent, single-colored, multi-colored, tinted or non-tinted. Additionally, like the cover layer 42, the coating 242 can include the indicia 44 such as, for example, grip replacement recommendations and/or instructions. The coating 242 can further reduce the vibration and shock transmitted to the user through the grip. The coating 242 is made of a rubber-like material, such as the product Plasti-Grip produced by PDI, Inc. of Circle Pines, Minn. The grip 28 can then be applied over the coating 242 to substantially cover the coating 242. Alternatively, the coating 242 can be applied directly to the pallet 26 without the pad 40, or the coating 242 can be applied over the pallet 26, the pad 40 and the cover layer 42.

In another alternative preferred embodiment, the elastomeric coating 242 of FIG. 6 can be directly applied to the pallet 126 (of FIG. 5), which is formed without a peripheral recess, and without a pad. The coating 242 is preferably inherently cushionable and, therefore, can reduce or eliminate the need for a pad. The grip 28 can then be applied over the coating 242 to substantially cover the coating 242.

While the preferred embodiments of the present invention have been described and illustrated, numerous departures therefrom can be contemplated by persons skilled in the art, for example, the pad and the cover layer can be each include multiple layers of material, or two or more sections positioned end to end. Therefore, the present invention is not limited to the foregoing description but only by the scope and spirit of the appended claims.

What is claimed is:

1. A handle assembly for a sports racquet having a head portion, the handle assembly comprising:

an elongate handle coupled to the head portion;

a pallet coupled to and longitudinally extending along the handle, the pallet having a proximal portion, a distal portion and a gripping portion disposed between the proximal and distal portions, the gripping portion having a polygonal-shaped transverse cross-sectional area and an outer surface, the outer surface of the gripping portion being stepped down with respect to the proximal and distal portions to form a recess about the substantially the entire periphery of the outer surface;

a pad having an inner surface and an outer surface, the inner surface of the pad coupled to the gripping portion of the pallet;

a cover layer extending over and substantially covering the pad and generally covering the proximal and distal portions of the pallet; and a grip is disposed over the cover layer.

2. The handle assembly of claim 1 wherein the cover layer comprises one of a shrinkable material and a conformable material.

3. The handle assembly of claim 1 wherein the cover layer is formed of a material selected from the group consisting of a transparent material, a translucent material, a semi-transparent material, and a semi-translucent material.

4. The handle assembly of claim 1 wherein the cover layer includes indicia selected the group consisting of graphical indicia, alphanumeric indicia, and combinations thereof.

5. The handle assembly of claim 1 wherein the pallet is integrally formed with the handle.

6. The handle assembly of claim 1 wherein the pallet is attached to the handle.

7. The handle assembly of claim 1 wherein the recess has a depth within the range of 0.25 and 3.0 mm.

8. The handle assembly of claim 1 wherein the gripping portion of the handle assembly has a length between 3.5 inches and 8.0 inches.

9. The handle assembly of claim 1 wherein the pad is made of a material selected from the group consisting of an open cell foam material, a closed cell foam material, other cushionable materials and combinations thereof.

10. A handle assembly for a sports racquet having a head portion, the handle assembly comprising: an elongate handle coupled to the head portion;

a pallet coupled to and longitudinally extending along the handle, the pallet having a proximal portion, a distal portion and a gripping portion disposed between the proximal and distal portions, the gripping portion being stepped down with respect to the proximal and distal portions to form a peripheral recess;

a pad having an inner surface and an outer surface, the inner surface of the pad coupled to the gripping portion of the pallet; and a cover layer extending over and substantially covering the pad and generally covering the proximal and distal portions of the pallet, the pad having a thickness which is greater than the depth of the recess, the cover layer bearing against the outer surface of the pad such that the transverse cross-sectional area of the handle assembly at the gripping portion is generally equal to the cross-sectional area of the handle assembly at the proximal portion.

11. The handle assembly of claim 10 wherein the cover layer comprises a shrinkable, conformable material.

12. The handle assembly of claim 10 wherein the cover layer is formed of a material selected from the group consisting of a transparent material, a translucent material, a semi-transparent material, and a semi-translucent material.

13. The handle assembly of claim 10 wherein the cover layer includes indicia selected the group consisting of graphical indicia, alphanumeric indicia, and combinations thereof.

14. The handle assembly of claim 10, further including a grip wrapped around the cover layer, and a butt cap attached to the handle assembly.

15. The handle assembly of claim 10 wherein the recess has a depth of at least 0.25 mm.

16. A handle assembly for a sports racquet having a head portion, the handle assembly comprising:

an elongate handle coupled to the head portion;

a pallet coupled to and longitudinally extending along the handle;

a cover layer extending over and generally covering the pallet, the cover layer having a smooth outer surface and a first thickness, the cover layer including indicia selected from the group consisting of graphical indicia, alphanumeric indicia, and combinations thereof; and a grip wrapped around the cover layer, the cover layer being configured to facilitate the removal of the grip, the grip having a second thickness that is greater than the first thickness of the cover layer.

17. The handle assembly of claim 16 wherein the cover layer comprises a shrinkable conformable material.

18. The handle assembly of claim 17, wherein the material of the cover layer is selected from the group consisting of polystyrene, polyvinylchloride, a polyolefin material, and combinations thereof.

19. The handle assembly of claim 16 wherein the cover layer is formed of a material selected from the group consisting of a transparent material, translucent material, a semi-transparent material, and a semi-translucent material.

20. The handle assembly of claim 16 wherein the pallet is integrally formed with the handle.

21. The handle assembly of claim 16 wherein the pallet is attached to the handle.

22. The handle assembly of claim 16, further comprising a butt cap attached to the handle assembly.

23. A handle assembly for a sports racquet having a head portion, the handle assembly comprising:

an elongate handle coupled to the head portion and extending along a longitudinal axis, the handle defining a pallet having a proximal portion, a distal portion and a gripping portion disposed between the proximal and distal portions, the distal portion having a first transverse polygonal cross-sectional area and the gripping portion having a second transverse polygonal cross-sectional area, the second polygonal cross-sectional area being smaller than the first polygonal cross-sectional area to define a peripheral recess in the pallet;

a pad removably coupled to the gripping portion of the pallet, the pad substantially filling the recess and the pad having a thickness which is greater than the depth of the recess; and a cover layer extending over and substantially covering an outer surface of the pad, the cover layer also generally covering the proximal and distal portions of the pallet, the cover layer bearing against the outer surface of the pad such that the handle assembly has a generally uniform transverse cross-sectional area.

24. The handle assembly of claim 23 wherein the proximal portion has a third transverse cross-sectional area and wherein the third transverse cross-sectional area is generally equivalent to the first transverse cross-sectional area.

25. The handle assembly of claim 23 wherein the cover layer comprises one of a shrinkable material and a conformable material.

26. The handle assembly of claim 23 wherein the cover layer is formed of a material selected from the group consisting of a transparent material, a translucent material, a semi-transparent material, and a semi-translucent material.

27. The handle assembly of claim 23 wherein the cover layer includes indicia selected the group consisting of graphical indicia, alphanumeric indicia, and combinations thereof.

28. The handle assembly of claim 23, further including a grip wrapped around the cover layer, and a butt cap attached to the handle assembly.

29. The handle assembly of claim 23 wherein the recess has a depth of at least 0.25 mm.

30. The handle assembly of claim 23 wherein the gripping portion of the handle assembly has a length between 3.5 inches and 8.0 inches.

31. The handle assembly of claim 23 wherein the pad is made of a material selected from the group consisting of an open cell foam material, a closed cell foam material, other cushionable materials and combinations thereof.

* * * * *